United States Patent [19]

Leopoldi

[11] 4,071,165

[45] Jan. 31, 1978

[54] PAPER DISPENSER HAVING A FRICTIONAL DISCHARGE ASSISTANT

[76] Inventor: Norbert Leopoldi, 4180 Marine Drive, Chicago, Ill. 60613

[21] Appl. No.: 644,557

[22] Filed: Dec. 29, 1975

[51] Int. Cl.[2] ..... G65G 59/02

[52] U.S. Cl. ..... 221/259; 221/272; 271/42

[58] Field of Search ..... 221/259, 270, 271, 244, 221/248, 272, 276, 260, 268, 269; 271/42, 128

[56] References Cited

U.S. PATENT DOCUMENTS

| | | | |
|---|---|---|---|
| 342,101 | 5/1886 | Hoyt | 221/259 X |
| 594,831 | 11/1897 | Jones | 271/42 |
| 2,299,940 | 10/1942 | Thomasma | 221/259 X |
| 3,094,323 | 6/1963 | Catania | 221/271 X |
| 3,517,855 | 6/1970 | Hillis | 221/259 |

*Primary Examiner*—Robert B. Reeves
*Assistant Examiner*—Fred A. Silverberg
*Attorney, Agent, or Firm*—Dominik, Knechtel, Godula & Demeur

[57] ABSTRACT

A paper dispenser which provides a receptacle for holding a supply of paper or memo sheets and having an overlying retainer hingedly mounted on the receptacle with a depending member pivotally mounted on the retainer adapted to engage a topmost sheet on the supply of sheets and advance one sheet at a time.

3 Claims, 5 Drawing Figures

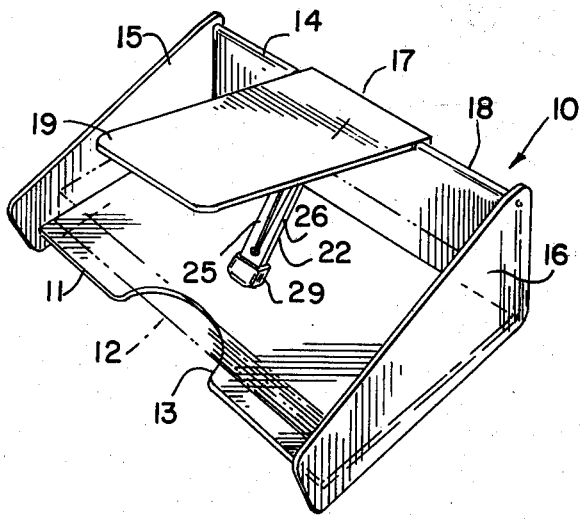
FIG. 1
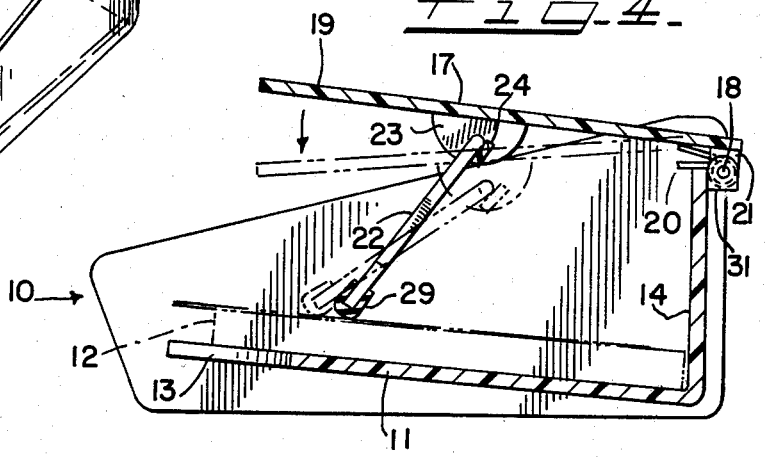
FIG. 4
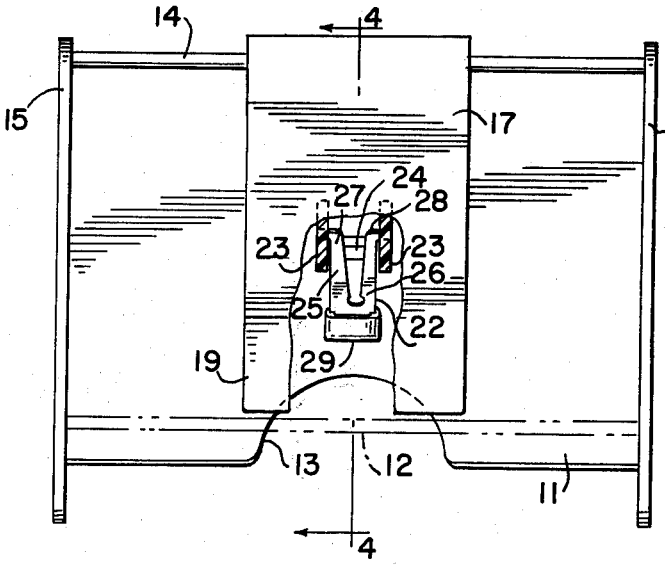
FIG. 2
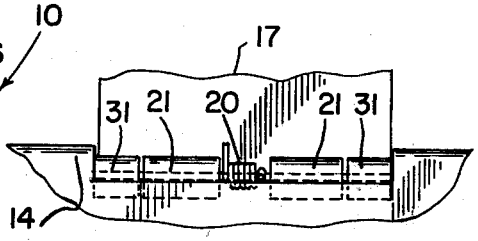
FIG. 5
FIG. 3
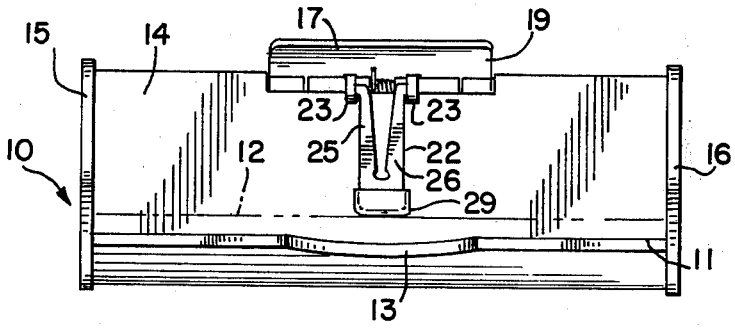

PAPER DISPENSER HAVING A FRICTIONAL DISCHARGE ASSISTANT

BACKGROUND OF THE INVENTION

Heretofore, receptacles have been provided for holding a supply of paper sheets from which the sheets were removed one at a time manually by fingering the sheets, as between the thumb and index finger, or by a moistened middle finger. Such receptacles sometimes took the form of an open top box, or one where one of the walls on a side or an end may have been cut down to afford access to the edges of the paper sheets for enabling the edges of the sheets to be engaged by a thumb or finger and thereby facilitate separation of the sheets and their removal one at a time. Such paper holders of this type were difficult to use in that single sheets were almost impossible to remove one at a time so that usually a stack of sheets were withdrawn and then all but the one to be utilized had to be replaced in the holder. This not only was inconvenient but the supply of papers were usually bent, or rumpled and thus made subsequent removals even more difficult.

SUMMARY OF THE INVENTION

The present invention overcomes all of these shortcomings and difficulties of such prior art devices and provides a paper holder that not only retains a supply of memo sheets in perfect form but also dispenses one of the sheets from the top of the pile one at a time without disturbing any of the sheets beneath the top and when the topmost sheet is removed the dispenser is automatically positioned to dispense the next sheet and is capable of repeating this operation until the entire stack of sheets in the holder is removed. This paper holder and dispenser comprises a three sided receptacle or container for a stack of paper memo sheets having a floor, an upright back wall and spaced side walls so diminished and arranged as to accommodate a stack of memo sheets of the standard size usually utilized on a desk or by a phone for making quick notes or reminders. The top side of the receptacle is open but a hinged retainer device is mounted on the rear wall of the receptacle in position to overlie the stack of sheets and more or less centrally disposed between the side walls. A depending dispenser member is pivotally mounted on the underside of the retainer and is normally disposed at an angle inclined toward the open front of the receptacle. A spring cushions the downward movement of the retainer. The dispenser member is provided with a foot which normally lies on the topmost memo sheet when the dispenser element is disposed at its natural angle and when the retainer is depressed the dispenser pivots on its mounting on the underside of the retainer whereby the foot moves outwardly toward the open front of the receptacle. The foot is of a nonmetallic material which frictionally engages the top memo sheet and thus when the dispenser pivots outwardly the top sheet on the stack is moved outwardly through the open front of the receptacle for ready removal as needed. When the dispensed sheet is removed the dispenser is in position automatically to engage the next sheet. The dispenser element positions itself automatically as downward pressure on the retainer member is released.

OBJECTS OF THE INVENTION

The primary purpose of this invention is to provide a paper holder and dispenser adapted to contain a stack of memo sheets and having a dispenser device which advances the topmost sheet for removal and which is automatically positioned to repeat each time a sheet is removed.

The principal object of the invention is the provision of a paper receptacle having a hingedly mounted top retainer member with a dispenser member pivotally mounted on the retainer member and having frictional engagement with a topmost sheet of a stack of sheets in the receptacle.

An important object of the invention is to provide a paper receptacle having a supporting floor for a stack of memo sheets, a rear wall and spaced apart side walls, with the front and top sides open and at least the front side unobstructed and wherein a top retainer member is hingedly mounted on the rear wall to overlie the stack of sheets and having a footed member pivotally mounted under the retainer with its free end engaging the topmost sheet of the stack.

Another object of the invention is the provision of a paper receptacle having a hinged cover spring cushion mounted on the receptacle and having a paper dispenser member pivotally mounted on the underside of the cover.

A further object of the invention is to provide a paper receptacle having a supporting floor for memo sheets and a rear wall with an open front and having a cover member overlying the memo sheets hingedly mounted on the rear wall with a torsional spring in the hinge and a dispenser arm pivotally mounted on the cover member with a nonmetallic foot frictionally engaging a top surface of the memo sheets.

DESCRIPTION OF THE DRAWINGS

The foregoing and more specific objects of the invention are attained by the paper dispenser structure and arrangement illustrated in the accompanying drawings wherein FIG. 1 is a general perspective view of the paper dispenser receptacle;

FIG. 2 is a top plan view of the paper receptacle with a portion of the top cover member broken away to reveal the pivotally mounted dispenser element;

FIG. 3 is a front elevational view of the paper dispenser receptacle;

FIG. 4 is a cross sectional view through the dispenser taken on line 4—4 of FIG. 2; and FIG. 5 is a detail view illustratiing the torsional spring installation in the hinge of the cover member for cushioning the action of the cover under downward pressure and to restore the cover and dispenser element to normal position.

DESCRIPTION OF PREFERRED EMBODIMENT

In the drawings 10 is a general reference character indicating the paper dispensing receptacle having a bottom floor 11 which as shown is inclined slightly to the rear for supporting a stack of memo sheets 12. The supporting floor 11 is provided with a central finger opening or cutaway portion 13 to provide ready access at a discharge opening to the stack of memo sheets or for replacing the stack when it has been fully utilized. A rear wall 14 extends upwardly from the bottom floor 11 at the back side of the paper receptacle and defines the front to rear position of the stack of memo sheets in the receptacle. A pair of side walls 15 and 16 enclose the two sides of the receptacle and define the positioning of the stack of memo sheets from side to side. The top and front portions of the receptacle are of open design and afford ready access to the receptacle for inserting the stack of memo sheets or for removing the entire stack for replacement for any reason as for changing the type of sheets or their color. The opening 13 in the botton floor 11 greatly facilitates such installation or replacement of the sheets.

A hinged cover, or retainer, is mounted on the rear wall 14 of the receptacle by means of a hinge pin 18 and extends in a single plane toward the front of the receptacle to the front end of the cover where it affords a conveniently placed flat area for engagement by the fingers of a user when it is desired to dispense a memo sheet. The cover or retainer 17 overlies the stack of memo sheets where it is disposed in upper normal position, as best shown in FIGS. 1 and 4, which position is maintained by a torsional spring 20 operatively mounted on the hinge pin 18, and urging the retainer upwardly from the bottom floor. As best shown in FIG. 5 the torsional spring is illustrated as being approximately centrally located between a pair of hinge lugs 21 on the underside of cover 17 and wrapped around the hinge pin element. One end of spring 20 projects outwardly under the cover 17 and bears against the underside of the cover to exert an upward pressure on the cover with the opposite projecting free end portion of the spring overlying and bearing against the upper edge of the rear wall 14 to provide the necessary bearing or reaction point. The spring construction is relatively light and provides only a mild resistance to downward movement of the cover 17 under finger pressure but is sufficient to restore the cover to its normal position overlying the stack of memo sheets. The hinge lugs 21 are pivotally supported on the hinge pin element 18 between a pair of hinge lugs 31 on the rear wall 14. These lugs 31 are on the rear face of wall 14 and the cover 17 overlies the hinge structure with the cover projecting rearwardly beyond wall 14.

A free hanging dispenser member 22 is pivotally mounted on the underside of the hinged cover 17 substantially forward of the rear wall, and is supported between a pair of depending mounting means or lugs 23 which are connected by a cross member 24 which acts as a stop to limit inward swinging movement of the dispenser member and thus position the dispenser element at a proper forward angle such that the inclination normally will cause the bottom end of the dispenser element to move outwardly or only at a forward angular movement toward the open front or discharge opening of the receptacle when the cover 17 is depressed against the urging of the resilient means. The dispenser member 22 is of bifurcated construction having separate arms 25 and 26 which afford sufficient resilience to enable the arms to be compressed for installation of the respective mounting trunnions 27 and 28 in the lugs 23. The bottom end of the dispenser member 22 is provided with a nonmetallic foot 29 which may be of rubber or a suitable synthetic to provide frictional engagement with the topmost memo sheet of the stack 12.

In operation the receptacle 10 is filled by the insetion of a stack of memo sheets 12 onto the supporting floor or bottom wall 11 against the rear wall 14 which is done with the top cover 17 and the associated dispenser member 22 in a raised position and with the stack 12 in place, the cover and dispenser element are lowered to normal position with foot 29 of the dispenser just resting on the topmost memo sheet 12. The tension of spring 20 is such that the cover 17 in this normal position is just balanced with the foot 29 bearing lightly on the topmost memo sheet 12 but is sufficient to return the cover to normal position after it has been depressed and released. When the cover 17 is depressed by finger pressure on the front portion thereof the dispenser menber 22 pivots forwardly away from the stop member 24 and the foot 29 moves toward the front of the receptacle 10, as indicated by the broken line position of the cover and dispenser element indicated in FIG. 4. The frictional engagement of the foot 29 with the topmost memo sheet causes that sheet to be slid forwardly through the open front of the receptacle where it may be grasped and removed for such use as desired.

What is claimed is:

1. A paper dispenser comprising in combination:

a receptacle for storing therein a stack of paper sheets, said receptacle having an open top, a bottom wall, side walls and a rear wall, the front of said receptacle being open to provide a forward discharge opening;

a retainer member hingedly affixed at one end thereof to a top edge of said rear wall substantially centrally between said side walls and overlying said bottom wall;

resilient means engaged with said retainer member and said rear wall for supporting said retainer member in a normal position overlying a stack of paper sheets stored within said receptacle, said resilient means providing only a mild resistance to downward movement of said retainer member under finger pressure and restoring said retainer member to its normal position when finger pressure is released;

a dispenser element having a foot on one end thereof for frictional engagement with the top sheet of a stack of paper sheets stored within said receptacle, said dispenser element being freely pivotally affixed at the other end thereof to said retainer member and being maintained at a forward angle by stop means which prevents rearward motion of said dispenser element such that only forward angular pivotal movement of said dispenser member is permitted;

said retainer member being manually operable in downward movement by finger pressure and being restored to its normal position when finger pressure is released, the downward movement of said retainer member frictionally engaging said foot on the one end of said dispenser member with the top sheet of a stack of paper sheets stored in said receptacle and further causing said dispenser member to pivot in a forward angular movement toward said discharge opening to slide the top sheet of the stack of paper sheets toward said discharge opening, whereby the top sheet is dispensed from said receptacle.

2. A paper dispenser, as claimed in claim 1, wherein said bottom wall of said receptacle is inclined rearwardly.

3. A paper dispenser, as claimed in claim 1, wherein said resilient means comprises a torsional spring mounted in the hinge means hingedly affixing said retainer member to said rear wall, the opposite ends of said torsional spring engaging said retainer means and said rear wall, respectively.

* * * * *